US005898346A

United States Patent [19]

Kamei et al.

[11] Patent Number: 5,898,346

[45] Date of Patent: Apr. 27, 1999

[54] DUAL-BAND NONREVERSIBLE CIRCUIT DEVICE COMPRISING TWO NONREVERSIBLE CIRCUIT ELEMENTS CONTAINED IN A SINGLE HOUSING TO BE OPERABLE IN DIFFERENT FREQUENCY BANDS

[75] Inventors: Koji Kamei; Atsushi Furuta; Norihiko Ono; Shigeyoshi Yoshida, all of Sendai; Kenji Takamoro, Tokyo, all of Japan

[73] Assignees: Tokin Corporation, Miyagi; NEC Corporation, Tokyo, both of Japan

[21] Appl. No.: 08/756,035

[22] Filed: Nov. 26, 1996

[30] Foreign Application Priority Data

Nov. 28, 1995 [JP] Japan ..... 7-308650

[51] Int. Cl.[6] ..... H01P 1/32

[52] U.S. Cl. ..... 333/1.1; 333/24.1

[58] Field of Search ..... 333/1.1, 24.1; 455/552, 553

[56] References Cited

U.S. PATENT DOCUMENTS

| | | | |
|---|---|---|---|
| 3,614,675 | 10/1971 | Kunishi . | |
| 3,781,704 | 12/1973 | De Gruyl | 333/1.1 |
| 3,890,582 | 6/1975 | Jeong . | |
| 5,185,587 | 2/1993 | Kurian et al. . | |
| 5,379,004 | 1/1995 | Marusawa et al. | 333/1.1 |
| 5,662,754 | 9/1997 | Marusawa et al. | 333/1.1 |

FOREIGN PATENT DOCUMENTS

| | | |
|---|---|---|
| 2019690 | 7/1970 | France . |
| 58-85609 | 5/1983 | Japan . |
| 2-55406 | 2/1990 | Japan . |
| 4-345201 | 12/1992 | Japan . |
| 1254764 | 11/1971 | United Kingdom . |

*Primary Examiner*—Reinhard J. Eisenzopf
*Assistant Examiner*—Makoto Aoki
*Attorney, Agent, or Firm*—Frishauf, Holtz, Goodman, Langer & Chick

[57] ABSTRACT

A dual-band nonreversible circuit device comprises a first circulator element (91) and a second circulator element (92) accommodated in a single housing (50, 50', 60) and operable around a first center frequency ($f_A$) and a second center frequency ($f_B$), respectively. The first circulator element (91) is formed by a combination of a first permanent magnet (31), a first ferrite plate (21) with a first center conductor (11), and a ground conductor plate (40) successively stacked on a lower magnetic yoke (50). Likewise, the second circulator element (92) is formed by a combination of the ground conductor plate (40), a second ferrite plate (22) with a second center conductor (12), and a second permanent magnet (32) successively stacked and covered by an upper magnetic yoke (60). Alternatively, a first circulator element (91') is formed by a combination of a first ground conductor plate (41), the first ferrite plate (21) with the first center conductor (11), and a permanent magnet (30) while the second circulator element (92') is formed by a combination of a second ground conductor plate (42), the second ferrite plate (22) with the second center conductor (12), and the permanent magnet (30).

2 Claims, 6 Drawing Sheets

DUAL-BAND NONREVERSIBLE CIRCUIT DEVICE COMPRISING TWO NONREVERSIBLE CIRCUIT ELEMENTS CONTAINED IN A SINGLE HOUSING TO BE OPERABLE IN DIFFERENT FREQUENCY BANDS

BACKGROUND OF THE INVENTION

This invention relates to a nonreversible circuit device for use in a terminal unit for transmission and reception in a radio communication system and, in particular, to a dual-band nonreversible circuit device operable in two different frequency bands specific to two different radio communication systems.

In recent years, technology has made remarkable progress in the field of radio communication. In many countries in the world, various radio communication systems are working and offered to users. However, those radio communication systems have different frequency bands assigned thereto. In order to enjoy the services of the various radio communication systems, it is necessary to use different terminal units for trans-mission and/or reception in the different frequency bands. Such use of the different terminal units is inconvenient and troublesome. In view of the above, consideration has recently made with respect to the necessity of a so-called dual-band terminal unit which is operable in two different frequency bands for two of the various radio communication systems.

The terminal unit typically includes a transmitter-receiver branching circuit for connecting a reception amplifier and a transmission amplifier to a common antenna and for isolating them from each other. The transmitter-receiver branching circuit generally includes components which are relatively large in size.

The transmitter-receiver branching circuit comprises a nonreversible circuit device. As an example of such a nonreversible circuit device, there is known a distributed-constant nonreversible circuit device comprising a magnet for generating a magnetic field, a set of center conductors, each serving as a signal path, a ferrite plate for providing the signal path with a unidirectional characteristic, and a ground conductor plate.

An improved nonreversible circuit device comprising two sets of center conductors arranged in a single magnetic circuit is disclosed, for example, in Japanese Unexamined Patent Publications Nos. 58-85609 (85609/1983) (Reference 1) and 4-345201 (345201/1992) (Reference 2).

In Reference 1, the two sets of center conductors are connected in cascade with each other in one-to-one correspondence and grounded in the single magnetic circuit so as to increase an inductance without increasing the size of the device. Thus, a small-sized high-performance nonreversible circuit device is obtained.

In Reference 2, the two sets of center conductors are connected in parallel with each other in one-to-one correspondence and grounded in the single magnetic circuit so as to decrease an inductance component and a d.c. resistance in a high-frequency region without increasing the size of the device. Thus, a small-sized nonreversible circuit device having excellent high-frequency characteristics is obtained.

It is noted here that the nonreversible circuit device described in each of References 1 and 2 is operable at a single operation frequency.

In order to use a single terminal unit in common in two different radio communication systems of two different frequencies, it has been a practice that the single terminal unit includes two transmitter-receiver branching circuits corresponding to the different frequencies. In addition, each of the transmitter-receiver branching circuits includes components which are relatively large in size as described in the foregoing. As a result, the terminal unit inevitably becomes bulky as a whole.

In view of achieving portability, however, it is desirable that the terminal unit is small in size and light in weight even in the case where the terminal unit is to be used in common in two different radio communication systems.

Reduction in size and weight of the terminal unit will be achieved if a single transmitter-receiver branching circuit is selectively operable at two different frequencies. In this event, the nonreversible circuit device is required to deal with the two different frequencies.

However, the nonreversible circuit device described in each of References 1 and 2 is operable at the single operation frequency. Therefore, for use in the two different radio communication systems of the two different frequencies, the terminal unit must include two nonreversible circuit devices corresponding to the two different frequencies. Thus, the nonreversible circuit device described in each of References 1 and 2 can not contribute to the reduction in size and weight of the terminal unit.

SUMMARY OF THE INVENTION

It is an object of this invention to provide a dual-band nonreversible circuit device which comprises two nonreversible circuit elements contained in a single housing to be operable at different operation frequencies and which is reduced in size and weight.

According to this invention, there is provided a dual-band nonreversible circuit device comprising two nonreversible circuit elements contained in a single housing. Each of the two nonreversible circuit elements comprises a ferrite plate, a set of center conductors, a magnet, and a ground electrode. The housing provides a magnetic circuit for a magnetic flux from the magnet to provide a magnetic field within the housing. The two nonreversible circuit elements are operable for different frequency bands within the single magnetic housing.

The dual-band nonreversible circuit device according to this invention is reduced in size and weight by adopting one of the following characteristics.

As one characteristic of this invention, the two nonreversible circuit elements operating within the single magnetic housing use a single ground electrode in common. The ground electrode forms a boundary between the two nonreversible circuit elements.

As the other characteristic of this invention, the two nonreversible circuit elements operating within the single magnetic housing use a single magnet in common. The magnet forms a boundary between the two nonreversible circuit elements.

In the dual-band nonreversible circuit device having one of the above-mentioned characteristics, each of the nonreversible circuit elements is a circulator element or an isolator element.

DESCRIPTION OF THE PREFERRED EMBODIMENTS

Figure 1:
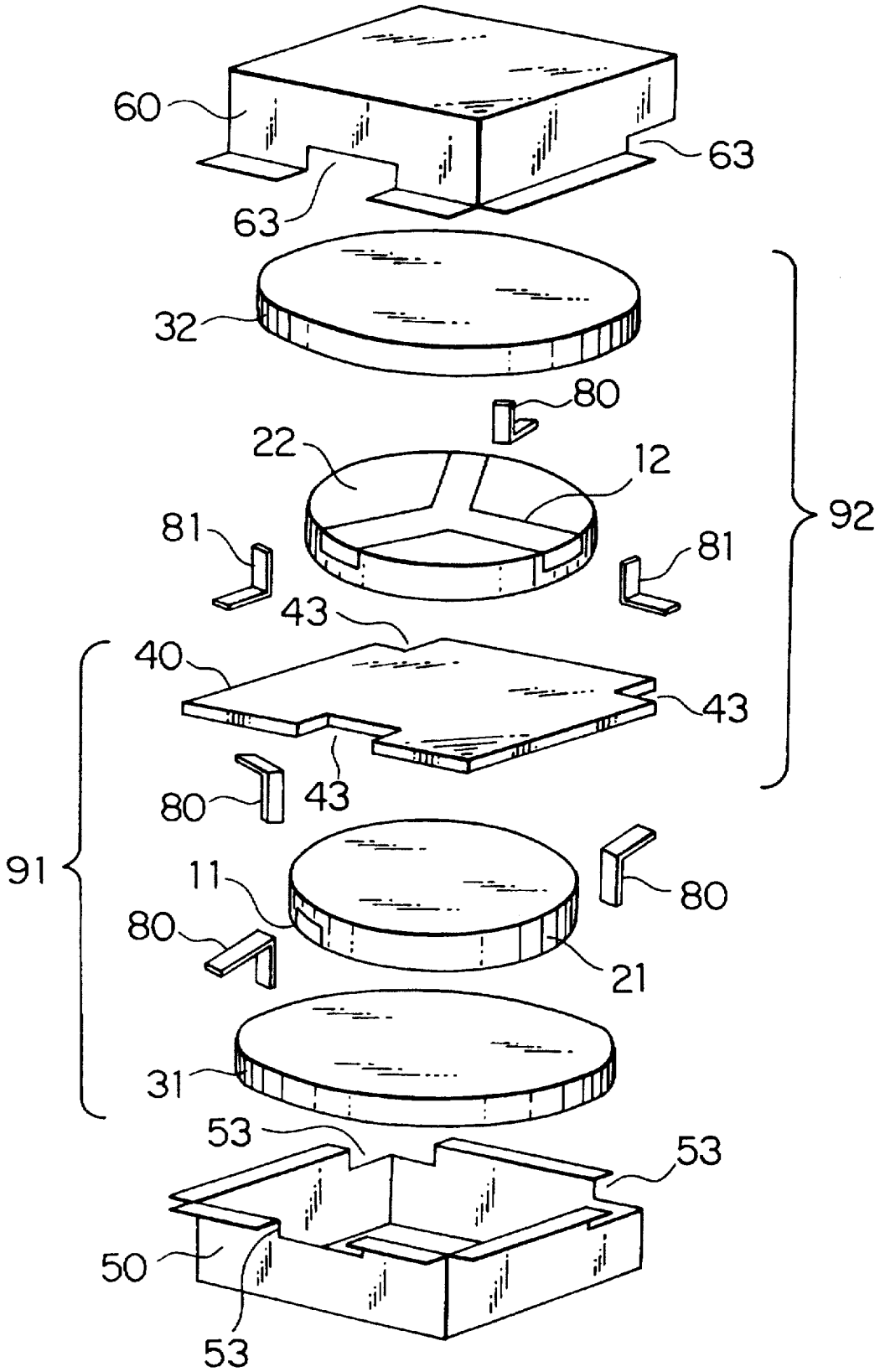
FIG. 1 is an exploded perspective view of a dual-band nonreversible circuit device according to a first embodiment of this invention.

Now, this invention will be described in detail in conjunction with two preferred embodiments thereof with reference to the drawing. Each of the preferred embodiments is directed to a dual-band circulator device comprising two circulator elements arranged in a single housing to be operable at different frequencies.

First Embodiment

Figure 2:
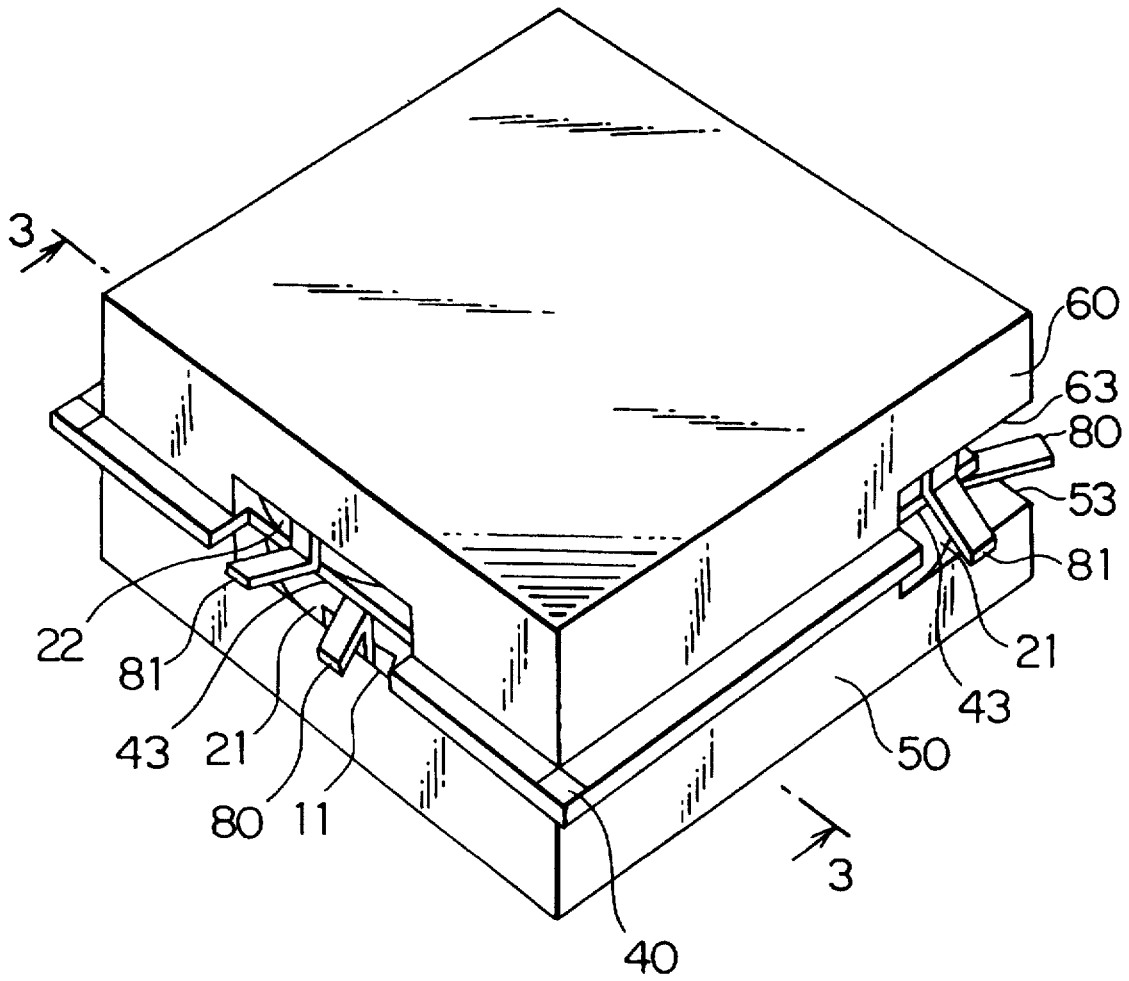
FIG. 2 is a perspective view of the dual-band nonreversible circuit device in FIG. 1 in an assembled state.
Figure 3:
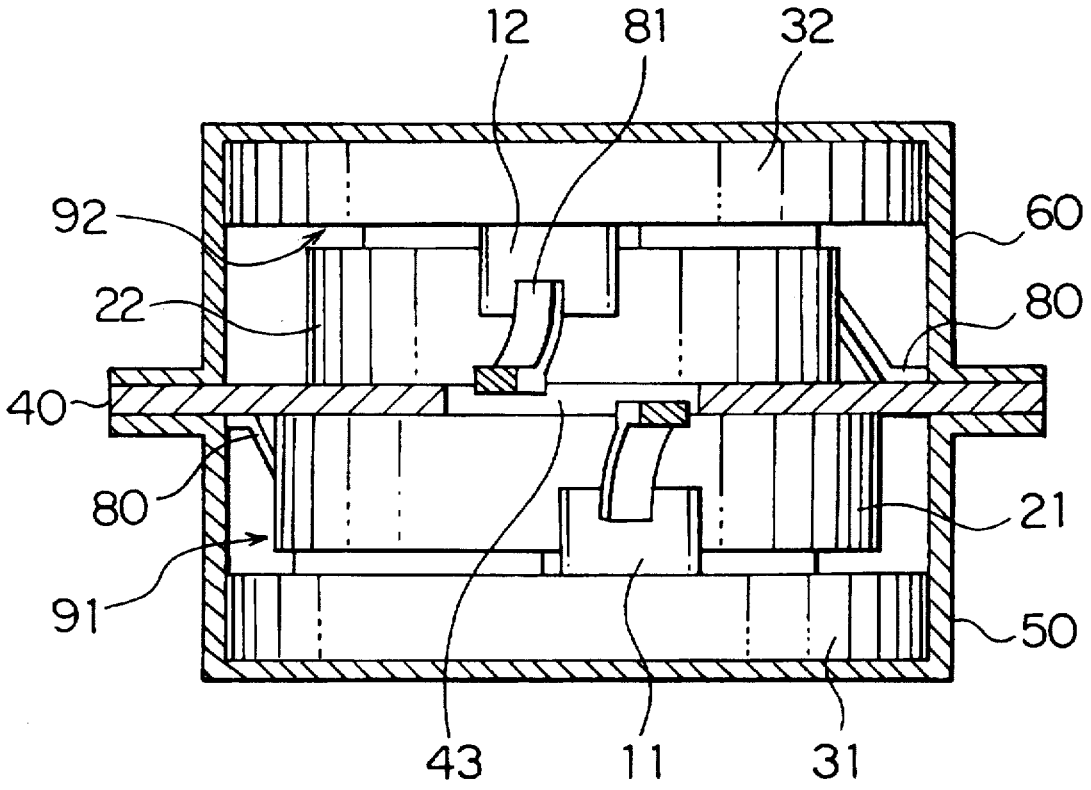
FIG. 3 is a sectional view taken along a line 3—3 in FIG. 2.

Referring to FIGS. 1 through 3, a dual-band circulator device according to a first embodiment will be described.

At first, description will be made as regards first and second ferrite plates 21 and 22 and first and second center conductors 11 and 12 used in the dual-band circulator device according to this embodiment.

Referring to FIG. 1, the first ferrite plate 21 of a disk shape has a primary surface (lower surface in FIG. 1) provided with the first center conductor 11 and a secondary surface (upper surface in FIG. 1) opposite to the primary surface. The first center conductor 11 is formed on the primary surface by plating to radially outwardly extend from the center of the primary surface in three directions angularly spaced by 120°. In order to facilitate connection to input/output terminals 80 which will later be described, the first center conductor 11 is extended onto a side surface of the first ferrite plate 21 to form extended ends. The secondary surface of the first ferrite plate 21 is subjected to plating, for example, nickel plating, in order to facilitate soldering as will later be described. Like the first ferrite plate 21, the second ferrite plate 22 has a primary surface (upper surface in FIG. 1) provided with the second center conductor 12 and a secondary surface (lower surface in FIG. 1) subjected to plating. The second center conductor 12 has extended ends to be connected to input/output terminals 81 which will later be described.

The dual-band circulator device according to the first embodiment has a structure which will presently be described.

Continuously referring to FIG. 1, a first permanent magnet 31 is stacked on a lower magnetic yoke 50 having notches 53. On the first permanent magnet 31, the first ferrite plate 21 is superposed so that the primary surface having the first center conductor 11 is brought into contact with the first permanent magnet 31. As a ground electrode, a ground conductor plate 40 having notches 43 is stacked on the first ferrite plate 21 so that the secondary surface of the first ferrite plate 21 is brought into contact with one surface of the ground conductor plate 40 namely, a lower surface in FIG. 1. In order to assure reliable grounding the secondary surface of the first ferrite plate 21 is fixed by soldering to the lower surface of the ground conductor plate 40.

On the ground conductor plate 40, the second ferrite plate 22 is stacked so that the secondary surface of the second ferrite plate 22 is brought into contact with the other surface of the ground conductor plate 40, namely, an upper surface in FIG. 1. In the manner similar to the first ferrite plate 21, the secondary surface of the second ferrite plate 22 is fixed by soldering to the upper surface of the ground conductor plate 40. On the second ferrite plate 22, a second permanent magnet 32 is superposed so that the primary surface having the second center conductor 12 is brought into contact with the second permanent magnet 32. On the second permanent magnet 32, an upper magnetic yoke 60 having notches 63 is stacked. A combination of the lower and the upper magnetic yokes 50 and 60 serves as a single housing which encloses the first permanent magnet 31, the first ferrite plate 21 with the first center conductor 11, the ground conductor plate 40, the second ferrite plate 22 with the second center conductor 12, and the second permanent magnet 32.

Each of the lower and the upper magnetic yokes 50 and 60 is made of a magnetic metal material so as to form a magnetic circuit for the magnetic flux from the first and the second permanent magnets 31 and 32 to thereby form a magnetic field within the single housing. On the other hand, the ground conductor plate 40 is made of a nonmagnetic metal material, for example, copper.

The ground conductor plate 40 is held between opening edges of the lower and the upper magnetic yokes 50 and 60 and is fixedly supported thereby.

Turning to FIGS. 2 and 3, the input/output terminals 80 and 81 of metal are connected to the extended ends of the first and the second center conductors 11 and 12, respectively. The input/output terminals 80 and 81 outwardly protrude through the notches 53 and 63 of the lower and the upper magnetic yokes 50 and 60, respectively.

Referring back to FIG. 1, a combination of the first permanent magnet 31, the first ferrite plate 21, the first center conductor 11, and the ground conductor plate 40 forms a first circulator element 91. Likewise, a combination of the second permanent magnet 32, the second ferrite plate 22, the second center conductor 12, and the ground conductor plate 40 forms a second circulator element 92. The first and the second circulator elements 91 and 92 are designed to be operable in different frequency bands having center frequencies $f_A$ and $f_B$, respectively.

As described above, the two circulator elements operable around the different center frequencies are vertically stacked and accommodated in the single housing. With this structure, the dual-band circulator device according to this embodiment can be mounted in an area equal to that required for a single circulator device. In the dual-band circulator device according to this embodiment, the two circulator elements use the single ground conductor plate in common. Thus, the dual-band circulator device is reduced in height as compared with a simple stack of two separate circulator devices including two ground conductor plates. In addition, the number of parts is reduced so that the production cost is saved as compared with manufacture of two circulator devices including two ground conductor plates.

In the first embodiment, the magnetic field is generated by the two permanent magnets, namely, the first and the second permanent magnets 31 and 32. It is noted here that the two permanent magnets can be replaced by a single permanent magnet as far as a magnetic field of a required level is generated. In this structure, however, either one of the first and the second center conductors 11 and 12 is brought into direct contact with a corresponding one of the lower and the upper magnetic yokes 50 and 60. Such direct contact must be avoided in any appropriate manner, for example, by the use of a spacer.

Second Embodiment

Next referring to FIGS. 4 through 6, a dual-band circulator device according to a second embodiment of this invention will be described.

The dual-band circulator device in this embodiment is similar in structure to the first embodiment except that the first and the second permanent magnets 31 and 32 are replaced by a single permanent magnet 30 and that the ground conductor plate 40 is replaced by first and second ground conductor plates 41 and 42. Similar parts are designated by like reference numerals.

Figure 4:
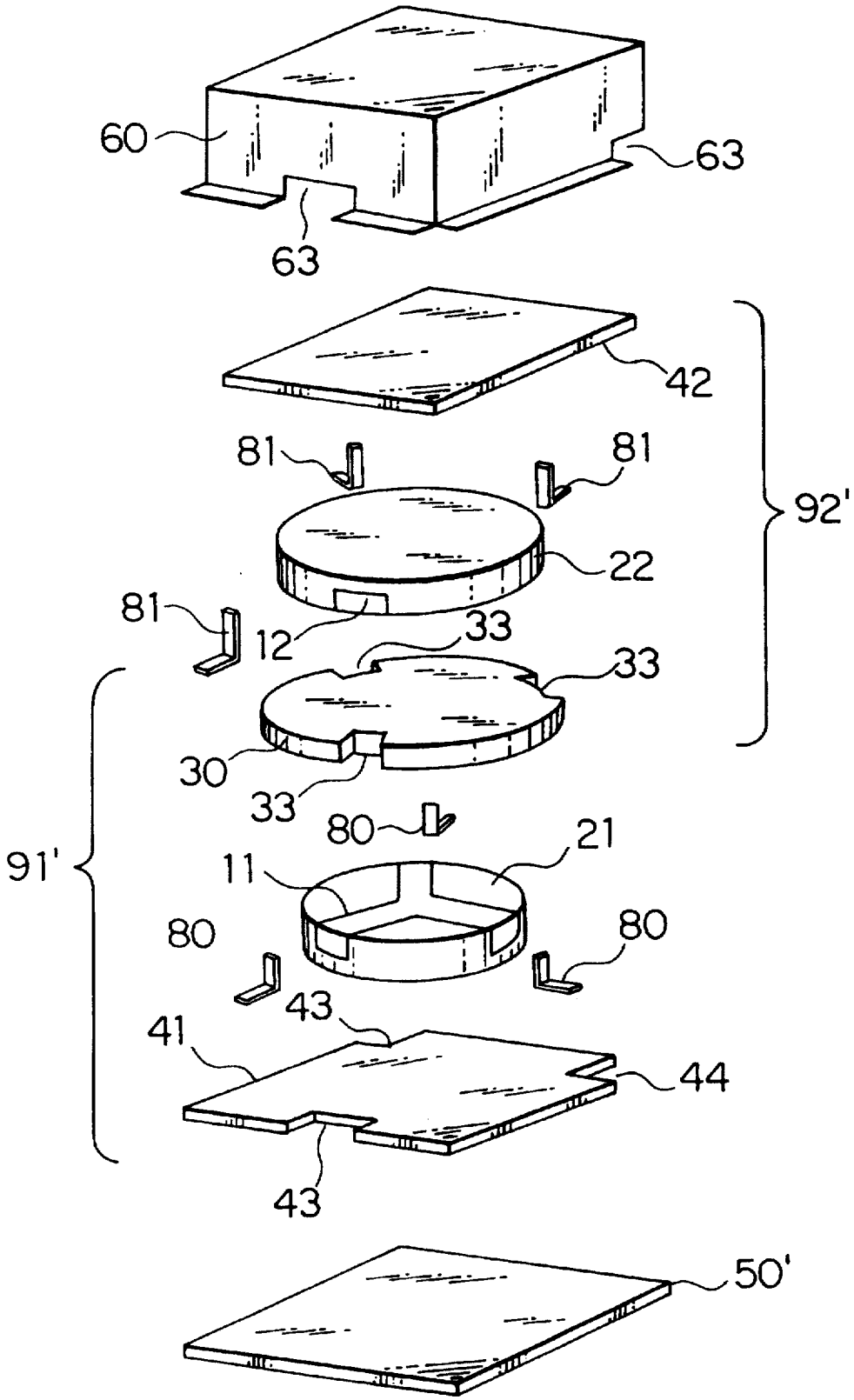
FIG. 4 is an exploded perspective view of a dual-band nonreversible circuit device according to a second embodiment of this invention.

Referring to FIG. 4, the first ground conductor plate 41 having notches 44 is stacked on a lower magnetic yoke 50'. On the first ground conductor plate 41, the first ferrite plate 21 is superposed so that the secondary surface of the first ferrite plate 21 is brought into contact with the first ground conductor plate 41. In order to assure reliable grounding, the secondary surface of the first ferrite plate 21 is fixed by soldering to the first ground conductor plate 41. On the first ferrite plate 21, a permanent magnet 30 having notches 33 is stacked so that the primary surface of the first ferrite plate 21 with the first center conductor 11 is brought into contact with one surface of the permanent magnet 30, namely, a lower surface in FIG. 4.

On the other surface of the permanent magnet 30, namely, an upper surface in FIG. 4, the second ferrite plate 22 is superposed so that the primary surface with the second center conductor 12 is brought into contact with the permanent magnet 30. On the second ferrite plate 22, the second ground conductor plate 42 is stacked so that the secondary surface of the second ferrite plate 22 is brought into contact with the second ground conductor plate 42. In the manner similar to that described in conjunction with the first ferrite plate 21, the secondary surface of the second ferrite plate 22 is fixed by soldering to the second ground conductor plate 42. On the second ground conductor plate 42, the upper magnetic yoke 60 having the notches 63 is stacked. Like in the embodiment in FIGS. 1 through 3, a combination of the lower and the upper magnetic yokes 50' and 60 serves as a single housing which encloses the first ground conductor plate 41, the first ferrite plate 21 with the first center conductor 11, the permanent magnet 30, the second ferrite plate 22 with the second center conductor 12, and the second ground conductor plate 42. Each of the lower and the upper magnetic yokes 50' and 60 is made of a magnetic metal material so as to form a magnetic circuit for the magnetic flux of the permanent magnet 30. On the other hand, each of the first and the second ground conductor plates 41 and 42 is made of a nonmagnetic metal material, for example, copper. The lower and the upper magnetic yokes 50' and 60 hold and support the first ground conductor plate 41 therebetween.

Figure 5:
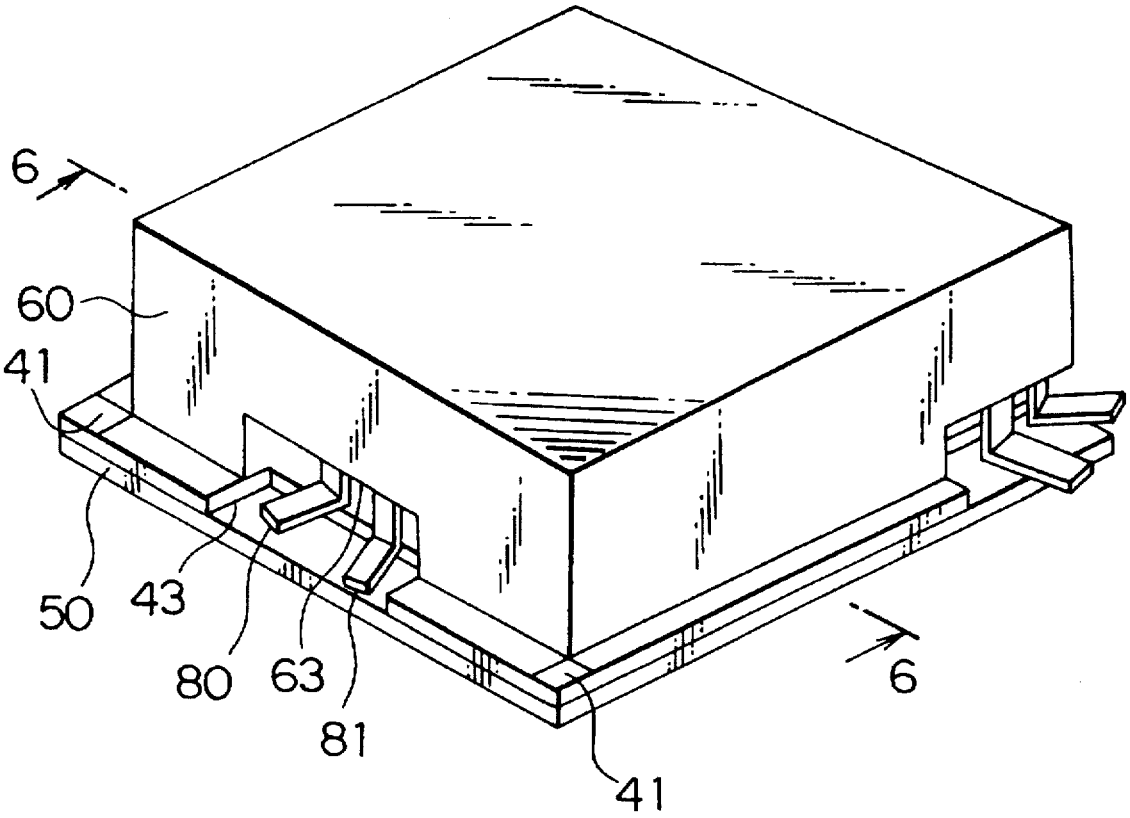
FIG. 5 is a perspective view of the dual-band nonreversible circuit device in FIG. 4 in an assembled state.
Figure 6:
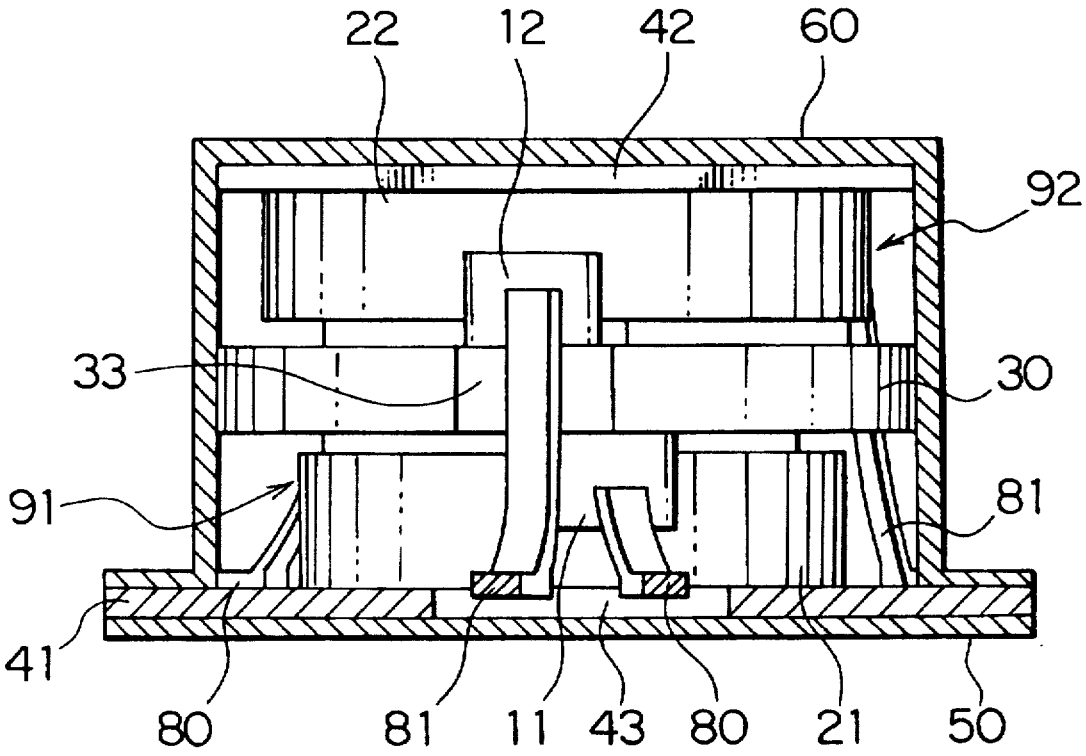
FIG. 6 is a sectional view taken along a line 6—6 in FIG. 5.

Turning to FIGS. 5 and 6, the input/output terminals 80 of metal are connected to the extended ends of the first center conductor 11. On the other hand, the input/output terminals 81 are connected to the extended ends of the second center conductor 12. The input/output terminals 80 and 81 outwardly protrude through the notches 63 of the upper magnetic yoke 60. As will be understood from FIGS. 5 and 6, in this embodiment, the input/output terminals 81 connected to the second center conductor 12 are longer than the input/output terminals 80 connected to the first center conductor 11 so as to outwardly protrude through the notches 63 of the upper magnetic yoke 60.

Referring back to FIG. 4, a combination of the permanent magnet 30, the first ferrite plate 21, the first center conductor 11, and the first ground conductor plate 41 forms a first circulator element 91'. Likewise, a combination of the permanent magnet 30, the second ferrite plate 22, the second center conductor 12, and the second ground conductor plate 42 forms a second circulator element 92'. In this embodiment also, the first and the second circulator elements 91' and 92' are designed to be operable in different frequency bands having different center frequencies.

The dual-band circulator device of the above-mentioned structure has advantages similar to those described in conjunction with the first embodiment.

In the second embodiment, each of the first and the second ground conductor plates 41 and 42 is made of a nonmagnetic metal material. If the first ground conductor plate 41 is made of a magnetic metal material, the first ground conductor plate 41 also serves as the lower magnetic yoke 50'. This makes it possible to further reduce the number of parts. For example, the first ground conductor plate 41 may comprise an iron plate subjected to nickel plating for surface protection.

While this invention has thus far been described in conjunction with a few preferred embodiments thereof, it will be understood for those skilled in the art to put this invention into practice in various other manners.

For example, each of the nonreversible circuit elements is not restricted to the distributed-constant circulator element described in the first and the second embodiments and may be any other appropriate element such as a lumped-constant circulator element.

Each of the ground conductor plates may comprise a printed board with a ground electrode patterned thereon. In this event, the input/output terminals may be implemented by any other appropriate structure. For example, use is made of a surface-mounting structure in which an input/output electrode is separately patterned on the printed circuit board.

In the first and the second embodiments, description is directed to the dual-band circulator device in which both of the two nonreversible circuit elements are the circulator elements. It will readily be understood that the circulator element acts as an isolator element if one terminal of the circulator element is terminated to a non-reflective resistance. In this manner, at least one of the two circulator elements of the dual-band circulator device may be transformed into the isolator element.

What is claimed is:

1. A dual-band nonreversible circuit device comprising:

two nonreversible circuit elements contained in a single housing; and a single common ground electrode forming a boundary between said two nonreversible circuit elements;

wherein each of said nonreversible circuit elements includes a ferrite plate, a center conductor, and a magnet; and wherein said two nonreversible circuit elements are operable in different frequency bands within said single housing, and said housing provides a magnetic circuit for a magnetic flux from said magnets to generate a magnetic field within said housing.

2. The nonreversible circuit device as recited in claim 1, wherein each of said nonreversible circuit elements comprises one of a circulator element and an isolator element.

* * * * *